United States Patent [19]

Karayannis

[11] 4,005,658

[45] Feb. 1, 1977

[54] SAFETY DEVICE FOR A CURRENT GENERATOR USED WITH AN ELECTRICAL PROJECTILE FUZE

[75] Inventor: Panayotis Karayannis, Zurich, Switzerland

[73] Assignee: Werkzeugmaschinenfabrik Oerlikon-Buhrle AG, Zurich, Switzerland

[22] Filed: Nov. 20, 1975

[21] Appl. No.: 633,925

[30] Foreign Application Priority Data

Dec. 13, 1974 Switzerland ..... 16589/74

[52] U.S. Cl. ..... 102/70.2 G

[51] Int. Cl.[2] ..... F42B 15/00; F42B 19/34; F42C 11/04; F42C 13/00

[58] Field of Search ..... 102/70.2 G, 70.2 GA

[56] References Cited

UNITED STATES PATENTS

| | | | |
|---|---|---|---|
| 2,703,530 | 3/1955 | McGee | 102/70.2 GA |
| 2,977,881 | 4/1961 | Piper | 102/70.2 G |

FOREIGN PATENTS OR APPLICATIONS

| | | | |
|---|---|---|---|
| 525,333 | 8/1940 | United Kingdom | 102/70.2 G |

*Primary Examiner*—Samuel W. Engle
*Assistant Examiner*—Thomas H. Webb
*Attorney, Agent, or Firm*—Werner W. Kleeman

[57] ABSTRACT

A safety device for a current generator of an electrical projectile fuze comprising a housing in which there are arranged a permanent magnet, an induction coil and a soft iron core. Of these components at least two are movable relative to one another. The movement preventing means comprise rods or the like which can buckle. The rods are secured at one end at a housing-fixed part and at the other end bear at the movable component and permit displacement of the aforementioned movable component first after overcoming the buckling resistance of the rods.

4 Claims, 4 Drawing Figures

SAFETY DEVICE FOR A CURRENT GENERATOR USED WITH AN ELECTRICAL PROJECTILE FUZE

BACKGROUND OF THE INVENTION

The present invention relates to a new and improved construction of a safety device for a current generator of an electrical projectile fuze, comprising a housing in which there are arranged a permanent magnet component, an induction coil component and a soft iron core component, two of these components are movable or displaceable relative to one antoher, and elements or means of the safety device prevent unintentional movement or displacement of the movable component or components.

There is already known to the art, a safety device for current generator means of an electrical fuze of this type, wherein the displaceable component or part, after firing or impact of the projectile, shears-off a safety element which elastically restrains or holds the displaceable component or part in such a manner that the elastic mounting or bearing arrangement is capable of resiliently absorbing shocks arising during transport of the projectile without destroying the safety element.

This state-of-the-art safety device no longer fulfills the high demands presently placed upon such type device. In the presence of extreme shocks or blows the danger still exists that such type safety element will be sheared away.

SUMMARY OF THE INVENTION

Hence, it is a primary object of the present invention to provide a new and improved construction of safety device for a current generator of an electrical projectile fuze which is not associated with the aformentioned drawbacks and limitations of the prior art proposals.

Another and more specific object of the present invention aims at a new and improved construction of safety device which first becomes ineffective upon firing when the inertia forces generated both due to the axial acceleration of the projectile as well as also due to its rotational acceleration act upon elements of the safety device which otherwise maintain the effectiveness of the safety device.

A further object of this invention relates to the provision of a new and improved construction of safety device for a current generator of an electrical projectile fuze which incorporates structures safeguarding against destruction of the safety element when exposed to pronounced shock or blows during transport and during such time as there are not effective any forces resulting from rotational acceleration.

Now in order to implement these and still further objects of the invention, which will become more readily apparent as the description proceeds, the safety device of the present invention is manifested by the features that the aforementioned means or elements of the safety device comprise rods or equivalent structure which can buckle, these rods bearing at one end upon a housing-fixed part and at their other end at the displaceable component and enable displacement of said displaceable component only after overcoming the buckling resistance of such rods or the like.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
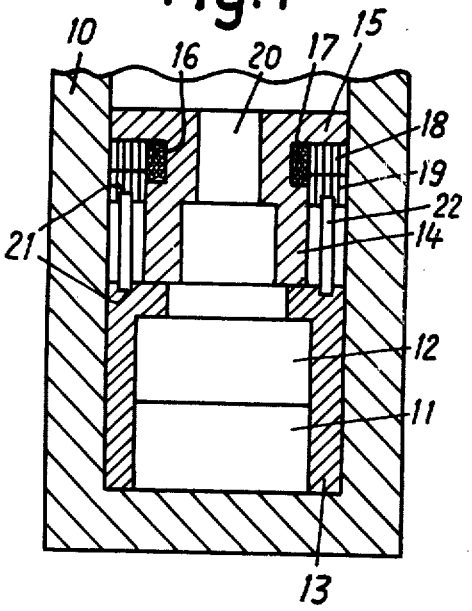
FIG. 1 is a fragmentary cross-sectional view of a fuze illustrated in its unarmed or safety position.

Describing now the drawings, it is to be understood that for the sake of simplicity in illustration only enough of the details of the projectile fuze have been shown to enable those skilled in the art to readily understand the underlying concepts of the present invention which is directed to the safety device thereof and which of course will be considered fully. Turning attention to FIG. 1, there will be recognized a housing 10 in which there is arranged a sleeve 13 or equivalent structure housing a conventional electronic control device 11 and an energy storage means, typically for instance a capacitor 12. Sleeve 13 defines a housing-fixed part or component, e.g. is press fitted. In order to charge the capacitor 12 there is provided a current generator possessing a core 14 formed of soft iron which is secured by means of its flange 15 in any suitable manner at the housing 10. The core 14 contains within a groove 16 an induction coil or induction coil component 17. Further, a substantially ring-shaped permanent magnet or permanent magnet component 18 and a soft iron ring or soft iron ring component 19 are displaceably arranged upon the core 14. The permanent magnet 18 and the soft iron ring 19 secured thereto can be displaced or moved out of a first position shown in FIG. 1 into a second position shown in FIG. 2. This displacement of the permanent magnet 18 and the soft iron ring 19 is greater than the width of the groove 16 provided for the induction coil or winding 17. The induction coil 17 is electrically connected in conventional manner with the capacitor 12. In this electrical circuit connection arrangement there can be incorporated a rectifier which prevents discharge of the charged capacitor 12 through the induction coil 17. Instead of the rectifier or rectifier arrangement there could be employed a switch which, following charging of the capacitor 12, renders possible interrupting the electrical connection between the induction coil 17 and the capacitor 12.

Further there is provided a switch which enables connecting the capacitor 12 with an electrical detonater cap which can be arranged in the space or compartment 20 in order to initiate detonation of the projectile. This switch either can be activated upon impact of the projectile at the target or by a timing relay which enables self-destruction of the projectile after the expiration of an adjustable period of time. There is additionally provided a further switch, for instance a centrifugal switch, which turns-on the timing relay at the start of rotation or spin of the projectile in order that the projectile can be exploded following the expiration of the set or adjusted time. Finally, there is provided a transport safety means or device which insures that the capacitor 12 cannot be charged during transport of the projectile due to an unintentional shock or blow which may be unintentionally applied to the projectile.

The foregoing structure is basically conventional in this art and therefore further details thereof as well as any further showing of certain of the described elements, apart from those illustrated, have been omitted to preserve clarity in illustration and to confine the disclosure to the actual improvement aspects of this development.

It is in fact the transport safety device or means which constitutes the actual invention of this disclosure and therefore the same will be now described in detail.

Figure 3:
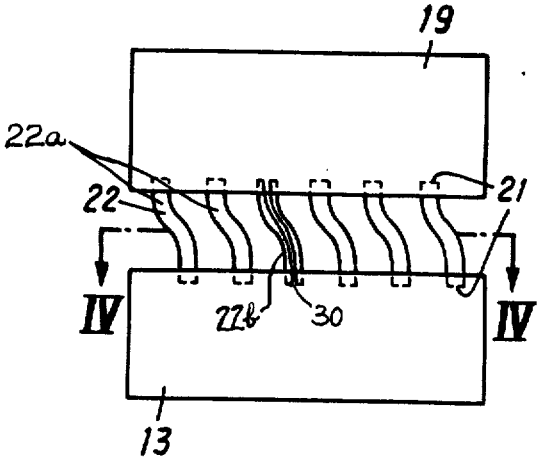
FIG. 3 is a schematic front view, on an enlarged scale, of a portion of the arrangement of FIGS. 1 and 2 during firing of the projectile.
Figure 4:
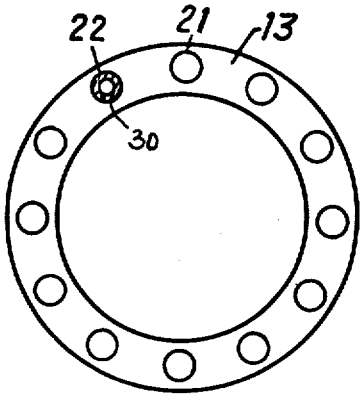
FIG. 4 is a cross-sectional view taken substantially along the line IV—IV of FIG. 3.

According to the showing of FIGS. 3 and 4 blindhole bores 21 or equivalent structure are preferably uniformly arranged about the periphery of both the soft iron ring component 19 and also the housing-fixed sleeve 13. Extending into oppositely situated blindhole bores 21 are the respective ends of rods or bars 22 or equivalent structure, these rods 22 being arranged essentially parallel to the fuze lengthwise axis in a circle or along a cylinder which is essentially concentric to such fuze axis. These rods 22 safeguard against a premature displacement of the permanent magnet component 18 and the soft iron ring component 19 and delay such displacement after firing the projectile.

Suitable for use as the rod 22 are, for instance, small tubes 22*a* each of which are slotted in their lengthwise direction, for instance as indicated by reference character 30 for the tube designated in FIG. 3 by reference character 22*b*, and therefore can resiliently bear at the wall of each associated blindhole bore 21. Instead of using small tubes or tubular members there can be employed small rods or bars 22 possessing an optional cross-sectional configuration, so that the buckling resistance of such rods 22 can be freely selected. Apart from the ability to freely select the cross-sectional shape of these elements it is also possible to freely select the wall thickness of such rods 22. Another optional selection which is possible relates to the number of rods 22.

The mode of operation of the described electrical fuze is as follows:

During transport of the projectile the rods 22 or equivalent structure prevent unintentional movement or displacement or the permanent magnet component 18 and the soft iron ring component 19.

Upon firing of the projectile the acceleration thereof is incapable of displacing or moving the permanent magnet component 18 and the soft iron ring component 19 for such length of time as the projectile guide band is not yet located along the course or extent of the weapon barrel and which guide band, as is known in this art, imparts the spin or rotation to the projectile. Only the inertia force acting at the permanent magnet or permanent magnet component 18 with the soft iron ring or soft iron ring component 19, due to the spin acceleration, is able to rotate such relative to the housing 10 and the therein secured sleeve 13. Due to this rotation the rods 22 bend. The start of this operation has been illustrated in FIG. 3. As soon as the axes of two oppositely situated blindhold bores 21 no longer coincide then the axial inertia force acting upon the permanent magnet component 18 and the soft iron ring component 19 is capable of buckling the rods 22, resulting in the component or parts 18 and 19 assuming the position shown in FIG. 2.

Displacement of the permanent magnet component 18 and the soft iron ring component 19 in thus first initiated after the spin acceleration and the axial acceleration of the projectile have reached a value which is dependent upon the resistance to deformation or buckling of the rods 22, i.e. under the action of large inertia forces, so that the change of the magnetic flux as a function of time becomes larger than would be the case if there were not provided any rods 22. Hence, with less windings of the coil it is possible to advantageously induce a predetermined voltage.

Figure 2:
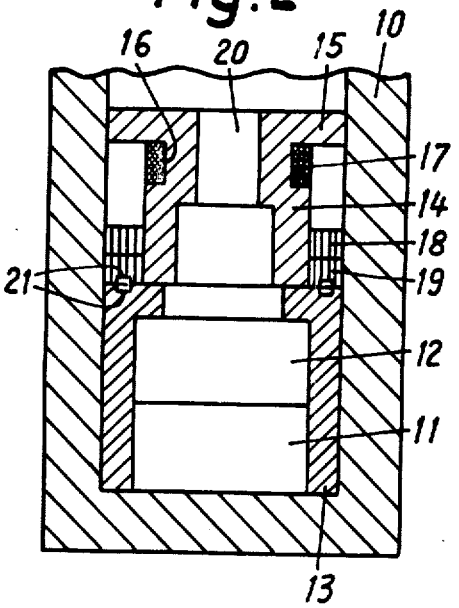
FIG. 2 illustrates the fuze of FIG. 1 after firing.

In FIG. 3 the rods 22 have been shown, for purposes of simplicity in the illustration, at the same spacing, although this is not completely correct. In FIG. 2 there has been neglected the thickness of the flatly pressed rods 22 which only amounts to a few hundredths of a millimeter.

While there are shown and described present preferred embodiments of the invention, it is to be distinctly understood that the invention is not limited thereto, but may be otherwise variously embodied and practiced within the scope of the following claims. ACCORDINGLY,

What is claimed is:

1. A safety device for a current generator of an electrical projectile fuze having a lengthwise axis for a projectile, comprising a housing member, a permanent magnet component, an induction coil component and a soft iron core component arranged in said housing member, two of said components being mounted to be relatively movable with respect to one another, means for preventing unintentional movement of the movable component, said movement preventing means comprising rods structured for buckling, a member fixed to the housing member, each of the rods having opposed ends and secured at one end to the housing-fixed member and at their other end at the movable component and permitting displacement of the movable component only after overcoming the buckling resistance of the rods, said rods being arranged along a cylinder surface extending about the lengthwise axis of the projectile fuze and in spaced relationship therefrom, said rods being subjected to compressive load in the axial direction by both said housing-fixed member and said movable component.

2. The safety device as defined in claim 1, wherein the rods each comprise a tubular-like member incorporating means imparting resilient properties to each said rod, the housing-fixed member having bore means for receiving the rods and the movable component having bore means for receiving the rods, each rod resiliently protruding at one end into said bore means of the housing-fixed member and at its other end resiliently protruding into said bore means of the movable component.

3. A safety device for a current generator of an electrical projectile fuze, comprising a housing member, a permanent magnet component, an induction coil component and a soft iron core component arranged in said housing member, two of said components being mounted to be relatively movable with respect to one another, means for preventing unintentional movement of the movable component, said movement preventing means comprising rods structured for buckling, a member fixed to the housing member, each of the rods having opposed ends and secured at one end to the housing-fixed member and at their other end at the movable component and permitting displacement of the movable component only after overcoming the buckling resistance of the rods, each rod comprising a tubular-like member incorporating means imparting resilient properties to each said rod, the housing-fixed member having bore means for receiving the rods and the movable component having bore means for receiving the rods, each rod resiliently protruding at one end into said bore means of the housing-fixed member and at its other end resiliently protruding into said bore means of the movable component, said resilient property-imparting means comprise slotted tubes defining the tubular-like members.

4. A safety device for a current generator of an electrical projectile fuze, comprising a housing member, a permanent magnet component, an induction coil component and a soft iron core component arranged in said housing member, at least two of said components being arranged to be relatively movable with respect to one another, means for preventing unintentional movement of the movable component, said movement preventing means comprising means structured for buckling, means fixed to the housing member, each of the means structured for buckling having opposed ends and secured at one end to the housing-fixed means and at their other end at the movable component in order to enable displacement of the movable component only after overcoming the buckling resistance of the means structural for buckling, said rods being arranged along a cylinder surface extending about the lengthwise axis of the projectile fuze and in spaced relationship therefrom, said rods being subjected to compressive load in the axial direction by both said housing-fixed member and said movable component.

* * * * *